US010399355B2

(12) United States Patent
Nakai et al.

(10) Patent No.: US 10,399,355 B2
(45) Date of Patent: Sep. 3, 2019

(54) LIQUID DISCHARGE HEAD, LIQUID DISCHARGE DEVICE, AND LIQUID DISCHARGE APPARATUS

(71) Applicants: Takayuki Nakai, Kanagawa (JP); Toshimichi Odaka, Kanagawa (JP); Takakazu Kihira, Ibaraki (JP); Takahiro Yoshida, Ibaraki (JP); Shiomi Andou, Kanagawa (JP); Yukio Otome, Ibaraki (JP); Katsuya Ishii, Ibaraki (JP)

(72) Inventors: Takayuki Nakai, Kanagawa (JP); Toshimichi Odaka, Kanagawa (JP); Takakazu Kihira, Ibaraki (JP); Takahiro Yoshida, Ibaraki (JP); Shiomi Andou, Kanagawa (JP); Yukio Otome, Ibaraki (JP); Katsuya Ishii, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/879,906

(22) Filed: Jan. 25, 2018

(65) Prior Publication Data

US 2018/0272743 A1 Sep. 27, 2018

(30) Foreign Application Priority Data

Mar. 21, 2017 (JP) ..... 2017-054254
Dec. 26, 2017 (JP) ..... 2017-250160

(51) Int. Cl.
*B41J 2/14* (2006.01)
*B41J 2/19* (2006.01)
(Continued)

(52) U.S. Cl.
CPC ..... *B41J 2/19* (2013.01); *B41J 2/14233* (2013.01); *B41J 2/14274* (2013.01); *B41J 2/175* (2013.01);
(Continued)

(58) Field of Classification Search
CPC ..... B41J 2/19; B41J 2/17596; B41J 2/14274; B41J 2/14233; B41J 2/18; B41J 2002/14338; B41J 2202/12
See application file for complete search history.

(56) References Cited

U.S. PATENT DOCUMENTS

2011/0242226 A1* 10/2011 Yoshida ..... B41J 2/14201 347/68
2012/0182352 A1* 7/2012 Fukada ..... B41J 2/14274 347/54
(Continued)

FOREIGN PATENT DOCUMENTS

JP 2015-071289 4/2015

OTHER PUBLICATIONS

Powerpoint of "Resistance in the Fluid System", retrieved on Oct. 4, 2018, retrieved from https://www.augusta.k12.va.us/cms/lib01/VA01000173/Centricity/Domain/396/Resistance_in_the_Fluid_System, slides 15-16 (Year: 2018).*
(Continued)

*Primary Examiner* — Lisa Solomon
(74) *Attorney, Agent, or Firm* — Oblon, McClelland, Maier & Neustadt, L.L.P.

(57) ABSTRACT

A liquid discharge head includes a plurality of nozzles to discharge a liquid, a plurality of individual chambers communicating with the plurality of nozzles, a plurality of discharge channels communicating with the plurality of individual chambers, a plurality of supply-side common chambers connected to the plurality of individual chambers, and a plurality of discharge-side common chambers connected to the plurality of discharge channels. The plurality of discharge-side common chamber has a same fluid resistance.

14 Claims, 18 Drawing Sheets

(51) Int. Cl.
*B41J 2/18* (2006.01)
*B41J 2/175* (2006.01)

(52) U.S. Cl.
CPC ..... *B41J 2/17509* (2013.01); *B41J 2/17596* (2013.01); *B41J 2/18* (2013.01); *B41J 2002/14338* (2013.01); *B41J 2002/14403* (2013.01); *B41J 2202/12* (2013.01); *B41J 2202/20* (2013.01); *B41J 2202/21* (2013.01)

(56) References Cited

U.S. PATENT DOCUMENTS

| | | | |
|---|---|---|---|
| 2015/0062255 | A1 | 3/2015 | Sasaki |
| 2016/0082728 | A1 | 3/2016 | Kohda et al. |
| 2016/0096369 | A1 | 4/2016 | Shimizu et al. |
| 2016/0185113 | A1 | 6/2016 | Yoshida et al. |
| 2017/0087865 | A1 | 3/2017 | Yoshida et al. |
| 2017/0096015 | A1 | 4/2017 | Odaka et al. |
| 2017/0120602 | A1 | 5/2017 | Nakai et al. |
| 2017/0157924 | A1 | 6/2017 | Otome et al. |
| 2017/0225485 | A1 | 8/2017 | Nakai |
| 2017/0297333 | A1 | 10/2017 | Kohda et al. |

OTHER PUBLICATIONS

IP.com search (Year: 2018).*

* cited by examiner

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2017-054254, filed on Mar. 21, 2017 in the Japan Patent Office, and Japanese Patent Application No. 2017-250160, filed on Dec. 26, 2017 in the Japan Patent Office, the entire disclosures of which are hereby incorporated by reference herein.

BACKGROUND

Technical Field

Aspects of the present disclosure relate to a liquid discharge head, a liquid discharge device, and a liquid discharge apparatus.

Related Art

As a liquid discharge head (hereinafter, simply referred to as "head") to discharge liquid, a circulation-type head is known. In the circulation-type head, liquid supplied from a supply-side common chamber to individual chambers and not discharged from the nozzles is returned and circulated from a liquid discharge channel to a discharge-side common chamber to enhance discharge-ability of bubbles in the individual chambers and ensure stable liquid characteristics.

SUMMARY

In one aspect of this disclosure, a novel liquid discharge head includes a plurality of nozzles to discharge a liquid, a plurality of individual chambers communicating with the plurality of nozzles, a plurality of discharge channels communicating with the plurality of individual chambers, a plurality of supply-side common chambers connected to the plurality of individual chambers, and a plurality of discharge-side common chambers connected to the plurality of discharge channels. The discharge-side common chambers all have the same fluid resistance.

In yet another aspect of this disclosure, a novel liquid discharge device includes the liquid discharge head as described above.

In still another aspect of this disclosure, a novel liquid discharge apparatus includes a liquid discharge device as described above.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
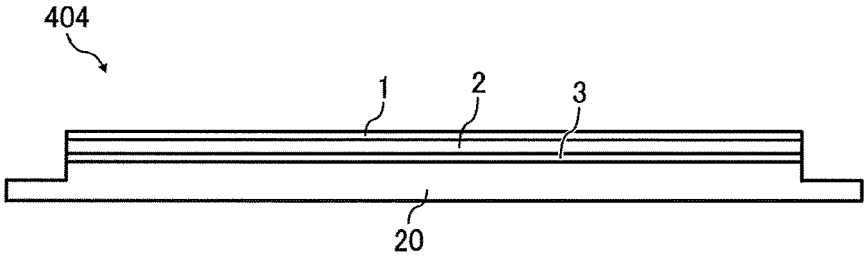
FIG. 1 is a side view of the head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Hereinafter, embodiments of the present disclosure are described with reference to the attached drawings.

FIGS. 1 to 4 illustrate a liquid discharge head 404 according to a first embodiment of the present disclosure. Hereinafter, "the liquid discharge head" is simply referred to as "head".

FIG. 1 is a side view of the head 404 according to the first embodiment.

Figure 2:
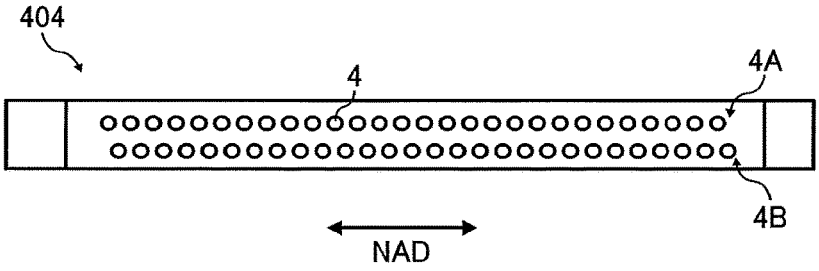
FIG. 2 is a plan view of the head illustrated in FIG. 1.

FIG. 2 is a plan view of the head 404.

Figure 3:
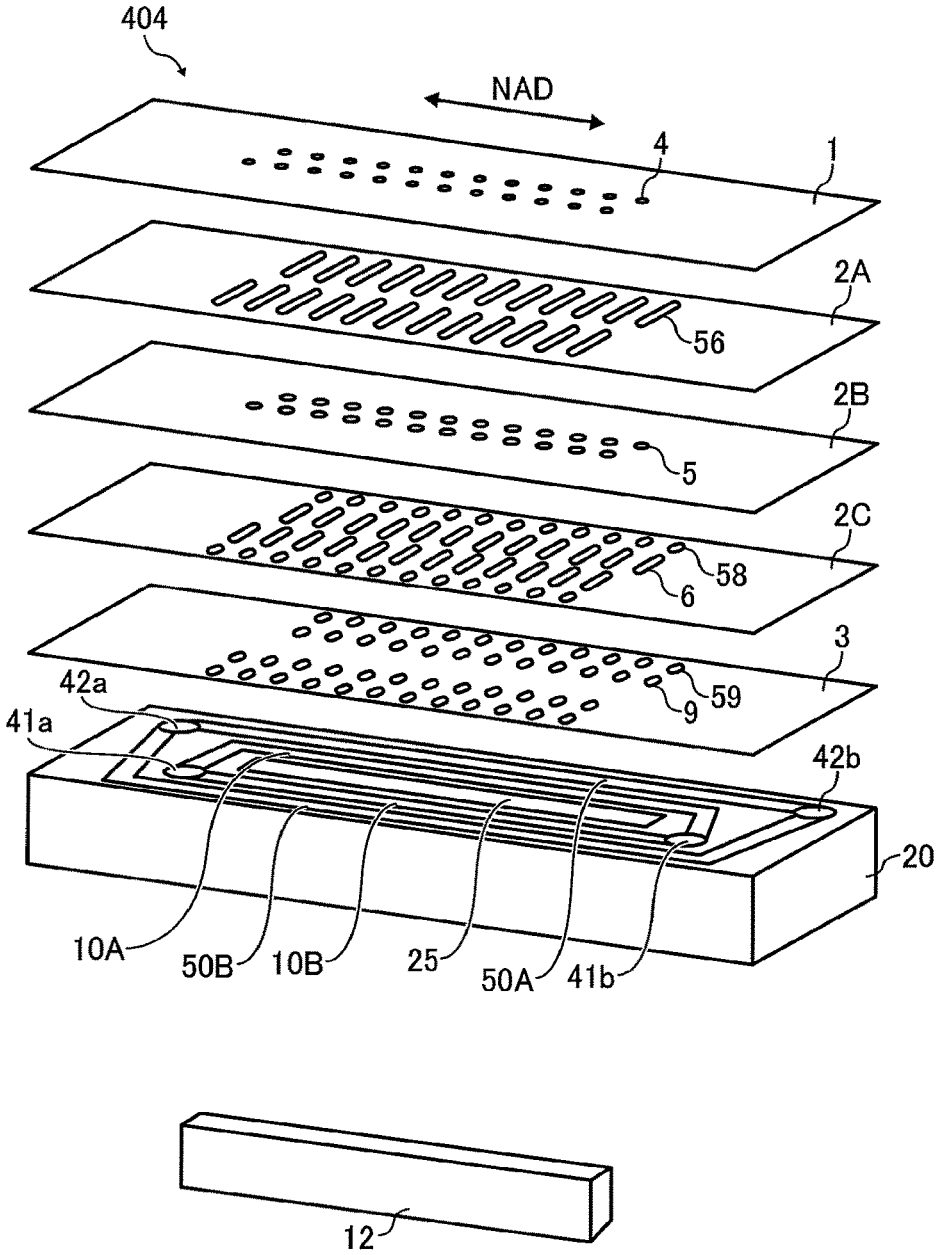
FIG. 3 is an exploded perspective view of the head.

FIG. 3 is an exploded perspective view of the head 404.

Figure 4:
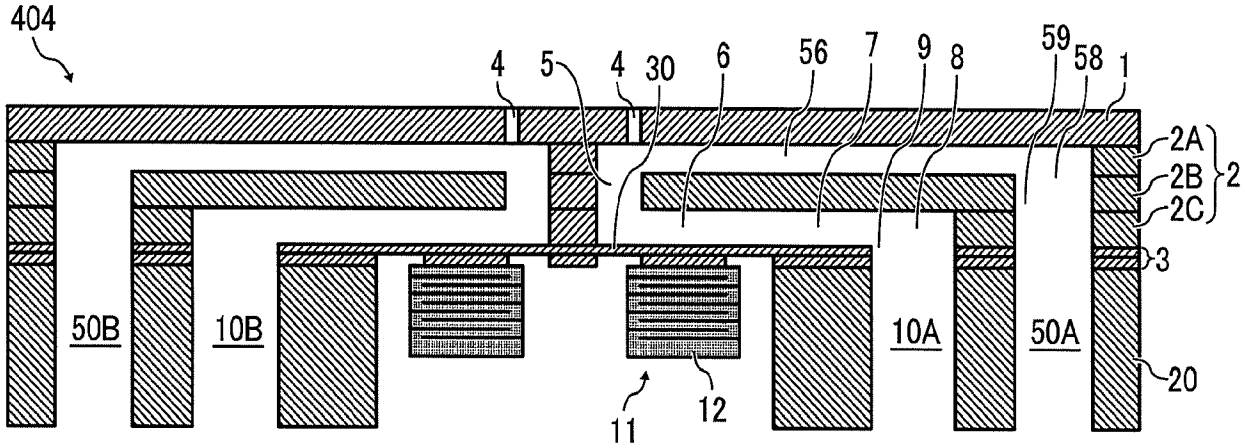
FIG. 4 is a cross-sectional view of the head along a direction perpendicular to a nozzle array direction in which nozzles are arrayed in a row.

FIG. 4 is a cross-sectional view of the head 404, cut along the direction perpendicular to a nozzle array direction indicated by arrow NAD in FIGS. 2 and 3. The nozzle array direction (NAD) is a direction in which nozzles are arrayed in a row.

The head 404 includes a nozzle plate 1, a channel substrate 2, and a diaphragm 3 serving as a wall. The nozzle plate 1, the channel substrate 2, and the diaphragm 3 are laminated one on another and bonded to each other.

As illustrated in FIG. 4, the head 404 includes piezoelectric actuators 11 to displace a vibration portion (vibration plate) 30 of the diaphragm 3, a common chamber substrate 20 as a frame member of the head 404, and a cover.

The nozzle plate 1 includes two rows of nozzle arrays 4A and 4B in which a plurality of nozzles 4 is arrayed. The head 404 discharges liquid from the nozzles 4 of the nozzle arrays 4A and 4B.

As illustrated in FIGS. 3 and 4, the channel substrate 2 includes through-holes and grooves that form individual chambers 6, supply-side fluid restrictors 7, and supply-side liquid introduction portions 8. The individual chambers 6 communicate with the nozzles 4 via nozzle communication channels 5. The supply-side fluid restrictors 7 communicate with the individual chambers 6 to configure a supply channel. The supply-side liquid introduction portions 8 communicate with the supply-side fluid restrictors 7.

The supply-side liquid introduction portions 8 can be configured to communicate with one or a plurality of supply-side fluid restrictors 7.

In the present embodiment, the channel substrate 2 includes three plate members 2A, 2B, and 2C laminated one atop the other.

The diaphragm 3 includes deformable vibration portions 30 constituting a wall of the individual chambers 6 of the channel substrate 2.

In the present embodiment, the diaphragm 3 has a two-layer structure including a first layer and a second layer. The first layer forms thin portions from the channel substrate 2. The second layer forms thick portions. The first layer includes the deformable vibration portions 30 at positions corresponding to the individual chambers 6. Note that the diaphragm 3 is not limited to the two-layer structure and the number of layers may be any other suitable number.

The piezoelectric actuator 11 is disposed on the opposite side of the individual chamber 6 of the diaphragm 3. The piezoelectric actuator 11 includes an electromechanical transducer element as a driver (e.g., actuator, pressure generator) to deform the vibration portions 30 of the diaphragm 3.

The piezoelectric actuator 11 is accommodated in an accommodating portion 25 (see FIG. 3) of the common chamber substrate 20.

The piezoelectric actuator 11 includes piezoelectric elements 12 bonded on a base 13. The piezoelectric elements 12 are groove-processed by half cut dicing so that each piezoelectric element 12 includes a desired number of pillar-shaped piezoelectric elements 12 that are arranged in certain intervals in the nozzle array direction (NAD) to have a comb shape.

The piezoelectric element 12 is joined to the vibration portions (vibration plate) 30 of the diaphragm 3.

This piezoelectric element 12 includes piezoelectric layers and internal electrodes alternately laminated. The internal electrodes are lead out to an end face of the piezoelectric element 12 to form external electrodes. The external electrodes are connected to a flexible wiring member.

The common chamber substrate 20 includes a supply-side common chamber 10 (10A and 10B) and a discharge-side common chamber 50 (50A and 50B).

The supply-side common chamber 10 (10A and 10B) is communicated with supply ports 41 (41*a* and 41*b*). The discharge-side common chamber 50 (50A and 50B) is communicated with the discharge ports 42 (42*a* and 42*b*) (See FIG. 3).

The supply-side common chamber 10 is communicated with the supply-side liquid introduction portions 8 via a supply-side opening 9.

The plate member 2A of the channel substrate 2 includes discharge channels 56 communicated with the individual chambers 6 via the nozzle communication channel 5.

Discharge-side fluid restrictors may be provided at the nozzle communication channel 5 side of the discharge channels 56.

The discharge channels 56 communicate with discharge-side liquid discharge portions 58.

Here, the discharge-side liquid discharge portions 58 communicate with one or plurality of the discharge channels 56.

The discharge-side liquid discharge portions 58 communicate with the discharge-side common chamber 50 via discharge-side opening 59.

In the head 404 thus configured, for example, when a voltage lower than a reference potential (intermediate potential) is applied to the piezoelectric element 12, the piezoelectric element 12 contracts. Accordingly, the vibration portions 30 of the diaphragm 3 are pulled to increase the volume of the individual chamber 6. Thus, liquid flows into the individual chamber 6.

Conversely, when the voltage applied to the piezoelectric element 12 is raised, the piezoelectric element 12 is pushed to extend in a direction of lamination.

Accordingly, the vibration portions 30 of the diaphragm 3 deform in a direction toward the nozzle 4 to reduce the volume of the individual chamber 6. Thus, liquid in the individual chamber 6 is pressurized and discharged from the nozzle 4.

Liquid not discharged from the nozzles 4 passes the nozzles 4 and is drained from the discharge-side opening 59 to the discharge-side common chamber 50 via the discharge channels 56 and the discharge-side liquid discharge portions 58. The liquid is supplied from the discharge-side common chamber 50 to the supply-side common chamber 10 again through an external circulation path.

Even when the liquid is not discharged from the nozzles 4, the liquid flows from the supply-side common chamber 10 to the discharge-side common chamber 50 via the individual chamber 6. Then, the liquid is supplied to the supply-side common chamber 10 again through the external circulation path.

Note that the driving method of the head 404 is not limited to the above-described example (pull-push discharge). For example, pull discharge or push discharge may be performed in response to the way to apply the drive waveform.

Figure 5A:
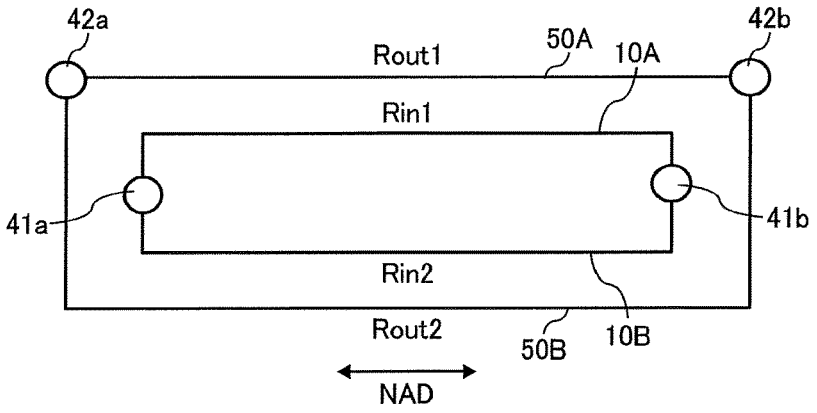
FIGS. 5A and 5B are schematic circuit diagrams illustrating a structure of the common chamber according to the present embodiment.
Figure 5B:
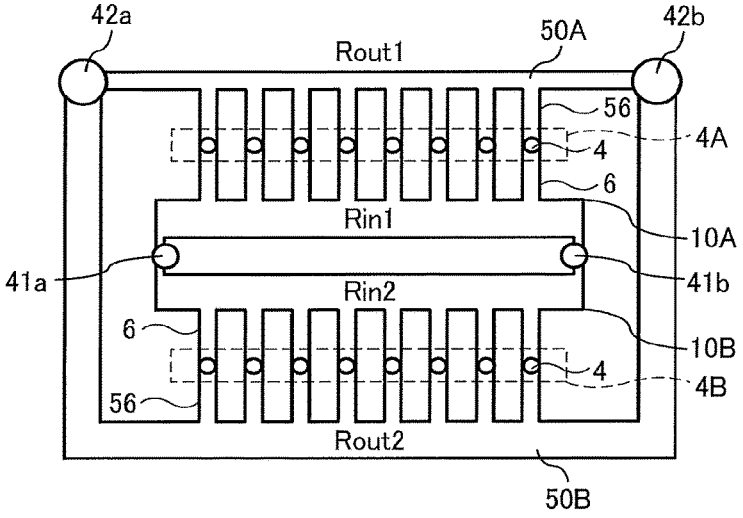

FIGS. 5A and 5B illustrate the common chambers 10A, 10B, 50A, and 50B in the head 404 according to the present embodiment. FIG. 5A is a schematic circuit diagram to illustrate a structure of the common chambers 10A, 10B, 50A, and 50B according to the present embodiment. FIG. 5B illustrates more specific structure of a flow path in the head 404 including the common chambers 10A, 10B, 50A, and 50B, the individual chambers 6, and the discharge channels 56.

This head 404 includes the supply-side common chambers 10A and 10B and the discharge-side common chambers 50A and 50B corresponding to the two nozzle arrays 4A and 4B. The supply-side common chambers 10A and 10B supply the liquid to the individual chambers 6 of the respective nozzle arrays 4A and 4B. The liquid is discharged from the discharge-side common chambers 50A and 50B to the discharge channels 56.

The supply-side common chamber 10A and the discharge-side common chamber 50A are arranged side by side in a direction perpendicular to the nozzle array direction NAD of the nozzle array 4A.

The supply-side common chamber 10B and the discharge-side common chamber 50B are arranged side by side in a direction perpendicular to the nozzle array direction NAD of the nozzle array 4B.

Here, the position of the discharge ports 42*a* and 42*b* are shifted from the position of the supply ports 41*a* and 41*b* in the direction perpendicular to the nozzle array direction NAD. The supply ports 41*a* and 41*b* supply the liquid to the supply-side common chambers 10A and 10B. The liquid is discharged from the discharge-side common chambers 50A and 50B to the discharge ports 42*a* and 42*b*.

To secure a certain flow rate, the supply ports 41*a* and 41*b* and the discharge ports 42*a* and 42*b* have a certain diameter. Thus, if the supply ports 41*a* and 41*b* and the discharge ports 42*a* and 42*b* are arranged in the nozzle array direction NAD, it is necessary to secure a certain distance between the supply port 41 and the discharge port 42. Thus, the size of the head 404 is increased in the longitudinal direction of the head 404 (nozzle array direction), resulting in an increase in size of the head 404.

However, in the present embodiment, the discharge port 42 is disposed close to one end of the head 404 in a direction perpendicular to the nozzle array direction (NAD). As a result, a length of the discharge-side common chamber 50A becomes different from a length of the discharge-side common chamber 50B. The length of the discharge-side common chamber 50A is a length of an upper side of channel between the discharge ports 42*a* and 42*b* as illustrated in FIG. 5. The length of the discharge-side common chamber 50B is a length of a lower side of channel between the discharge ports 42*a* and 42*b* as illustrated in FIG. 5.

Here, in the present embodiment, the fluid resistance of the discharge-side common chambers 50A is represented by Rout1, and the fluid resistance of the discharge-side common chambers 50B is represented by Rout2. A length of the discharge-side common chambers 50A is different from a length of the discharge-side common chambers 50B. Specifically, the length of the discharge-side common chambers 50A is shorter than the length of the discharge-side common chambers 50B.

Further, the discharge-side common chambers 50A and 50B are configured to satisfy the relation of Rout1=Rout2. That is, the fluid resistance Rout1 of the discharge-side common chambers 50A is equal to the fluid resistance Rout2 of the discharge-side common chambers 50B.

For example, in FIG. 5B, a cross-sectional area of the discharge-side common chambers 50A is made smaller than a cross-sectional area of the discharge-side common chambers 50B in a direction perpendicular to a direction of liquid flow so that the fluid resistance Rout1 of the discharge-side common chambers 50A becomes equal to the fluid resistance Rout2 of the discharge-side common chambers 50B even though the length of the discharge-side common chambers 50A is shorter than the length of the discharge-side common chambers 50B.

The term "fluid resistance" as used herein refers to the resistance between the discharge ports 42*a* and 42*b* when the two discharge ports (42*a* and 42*b*) are connected as illustrated in FIG. 5. When there is only one discharge port 42, the "fluid resistance" indicates a fluid resistance between the discharge port 42 and the individual chamber 6 farthest from the discharge port 42.

Considering manufacturing variations and the like, when the difference (variance) in the fluid resistance is within 10%, the fluid resistance can be considered to be substantially identical.

However, the difference (fluctuation) in fluid resistance is preferably controlled within 5%, particularly preferably 3% or less.

Thus, the present embodiment can reduce variations in discharge characteristics between the nozzle arrays 4A and 4B due to the difference in liquid flow between the nozzle arrays 4A and 4B.

Here, the fluid resistance is obtained from the following Equation 1.

$$R = \frac{12 \times \mu \times 1}{h \times w^3} \frac{1}{1 - \frac{192 \times w}{\pi^5 \times h} \Sigma_{n=1,3}^{\infty}{}_N \frac{1}{n^5} \tanh\left(\frac{n \times \pi \times h}{2 \times w}\right)} \quad \text{[Equation 1]}$$

where:

μ: viscosity l: length of channel h: height of channel w: width of channel

Therefore, it is possible to change the fluid resistance by changing a height and a width of a flow path of the discharge-side common chamber 50A and 50B.

In this case, as illustrated in FIGS. 5A and 5B, if lengths of the supply-side common chamber 10A and 10B (length between the supply ports 41*a* and 41*b*) are identical, it is easy to make a fluid resistance Rin1 of the supply-side common chamber 10A to be equal to a fluid resistance Rin2 of the supply-side common chamber 10B.

If the lengths of the supply-side common chamber 10A and 10B (length between the supply ports 41*a* and 41*b*) are different, a shape of the flow path of the supply-side common chamber 10A and 10B may be configured to make the fluid resistance Rin1 to be equal to the fluid resistance Rin2.

Thus, the present embodiment can reduce variations in the discharge characteristics between the nozzle arrays 4A and 4B by making the fluid resistance Rin1 of the supply-side common chamber 10A to be equal to the fluid resistance Rin2 of the supply-side common chamber 10B in addition to changes made in the configuration of the discharge-side common chambers 50A and 50B as described above.

As illustrated in FIG. 5B, the liquid discharge head 404 includes a plurality of nozzles 4 to discharge a liquid, a plurality of individual chambers 6 communicating with the plurality of nozzles 4, respectively, a plurality of discharge channels 56 communicating with the plurality of individual chambers 6, respectively, a plurality of supply-side common chambers 10A and 10B connected to the plurality of individual chambers 6, and a plurality of discharge-side common chambers 50A and 50B connected to the plurality of discharge channels 56. The plurality of discharge-side common chamber 50A and 50B having a same fluid resistance (Rout1=Rout2).

Further, the plurality of supply-side common chambers 10A and 10B has a same fluid resistance (Rin1=Rin2).

Further, the plurality of supply-side common chambers 10A and 10B includes a first supply-side common chamber 10A and a second supply-side common chamber 10B, and the plurality of discharge-side common chambers 50A and 50B includes a first discharge-side common chamber 50A and a second discharge-side common chamber 50B.

Both ends of the first supply-side common chamber 10A are connected to both ends of the second supply-side common chamber 10B, respectively, at the supply ports 41*a* and 41*b*. Both ends of the first discharge-side common chamber 50A are connected to both ends of the second discharge-side common chamber 50B, respectively, at the discharge ports 42*a* and 42*b*.

A sum (Rin1+Rout1) of a fluid resistance Rin1 of the first supply-side common chamber 10A and a fluid resistance Rout1 of the first discharge-side common chamber 50A is equal to a sum (Rin2+Rout2) of a fluid resistance Rin2 of the second supply-side common chamber 10B and a fluid resistance Rout2 of the second discharge-side common chamber 50B (Rin1+Rout1=Rin2+Rout2).

Further, a length of the first discharge-side common chamber 50A is shorter than a length of the second discharge-side common chamber 50B.

The first supply-side common chamber 10A is connected to the first discharge-side common chamber 50A via a first group of the plurality of individual chambers 6 and the plurality of discharge channels 56, and the second supply-side common chamber 10B is connected to the second discharge-side common chamber 50B via a second group of the plurality of individual chambers 6 and the plurality of discharge channels 56.

The first group of the plurality of individual chambers 6 and the plurality of discharge channels 56 communicates with the nozzles 4 that constitute nozzle array 4A. The second group of the plurality of individual chambers 6 and the plurality of discharge channels 56 communicates with the nozzles 4 that constitute nozzle array 4B.

A second embodiment according to the present disclosure is described with reference to FIG. 6.

Figure 6:
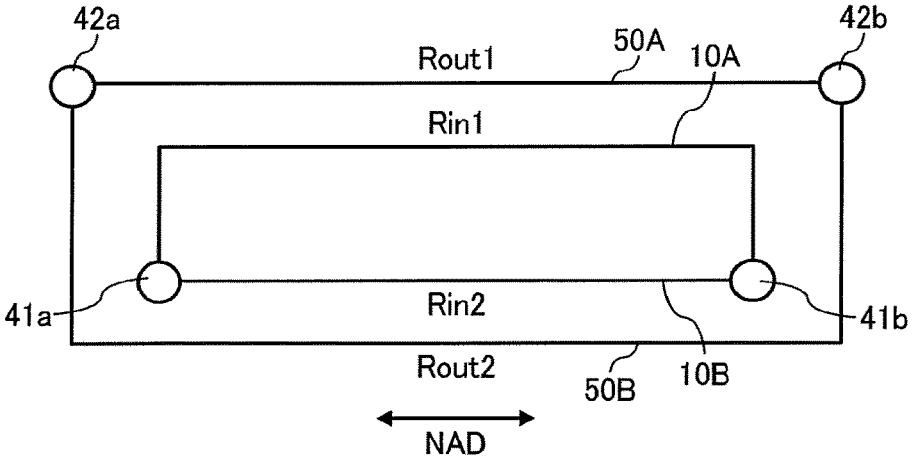
FIG. 6 is an equivalent circuit from the supply port to the discharge port.

FIG. 6 is a schematic circuit diagram to illustrate a structure of the common chamber according to the present embodiment.

Here, the supply ports 41*a* and 41*b* for supplying the liquid to the supply-side common chambers 10A and 10B are shifted to one side (lower side in FIG. 6) of the head 404 in a direction perpendicular to the nozzle array direction (NAD).

Similarly, the discharge ports 42*a* and 42*b* for discharging the liquid from the discharge-side common chambers 50A and 50B are shifted to another side (upper side in FIG. 6) of the head 404 in a direction perpendicular to the nozzle array direction (NAD).

In this way, the present embodiment disposes the supply ports 41*a* and 41*b* and the discharge ports 42*a* and 42*b* on an opposite side in the direction perpendicular to the nozzle array direction (NAD). Thus, the present embodiment can distribute positions of the supply ports 41*a* and 41*b* and the discharge ports 42*a* and 42*b* at different positions. The supply ports 41*a* 41*b* and the discharge ports 42*a* and 42*b* require a certain hole diameter to secure flow rate. Thus, it is possible to reduce a length of the head 404 in a longitudinal direction (nozzle array direction (NAD)) of the head 404.

At this time, the lengths of the supply-side common chamber 10A and 10B (length between the supply ports 41*a* and 41*b*) become different by shifting the supply ports 41*a* and 41*b* to one side of the head 404 in the direction perpendicular to the nozzle array direction (NAD).

Similarly, the lengths of the discharge-side common chamber 50A and 50B (length between the discharge ports 42*a* and 42*b*) become different by shifting the discharge ports 42*a* and 42*b* to another side of the head 404 in the direction perpendicular to the nozzle array direction (NAD).

Thus, as illustrated in FIG. 6, a length of the first supply-side common chamber 10A is longer than a length of the second supply-side common chamber 10B. Further, a length of the first supply-side common chamber 10A is longer than a length of the first discharge-side common chamber 50A, and a length of the second supply-side common chamber 10B is shorter than a length of the second discharge-side common chamber 50B.

This present embodiment is configured such that the fluid resistance Rin1 of the supply-side common chamber 10A, the fluid resistance Rin2 of the supply-side common chamber 10B, the fluid resistance Rout1 of the discharge-side common chamber 50A, and the fluid resistance Rout2 of the discharge-side common chamber 50B satisfy a relation of Rin1+Rout1=Rin2+Rout2.

That is, the supply-side common chamber 10A, the supply-side common chamber 10B, the discharge-side common chamber 50A, and the discharge-side common chamber 50B are formed to satisfy the relation of Rin1+Rout1=Rin2+Rout2.

In FIG. 6, the plurality of discharge-side common chamber 50A and 50B may have the same fluid resistance (Rout1=Rout2). Further, the plurality of supply-side common chambers 10A and 10B may have the same fluid resistance (Rin1=Rin2).

The term "fluid resistance" as used herein refers to a resistance value between the supply ports 41*a* and 41*b* or a resistance value between the discharge ports 42*a* and 42*b* when two supply ports 41*a* and 41*b* or two discharge ports 42*a* and 42*b* are connected as illustrated in FIG. 5.

When there is only one supply port 41 or only one discharge port 42, the resistance value means a value of fluid resistance between the individual chamber 6, which is farthest from the supply port 41 or the discharge port 42, and the supply port 41 or the discharge port 42.

Considering a manufacturing variations and the like, when the difference (variance) in the fluid resistance is within 10%, the fluid resistance can be considered to be substantially identical.

However, the difference (fluctuation) in fluid resistance is preferably controlled within 5%, particularly preferably 3% or less.

Thus, the present embodiment can reduce variations in discharge characteristics between the nozzle arrays 4A and 4B.

The above-described point is described with reference also to FIG. 7.

Figure 7:
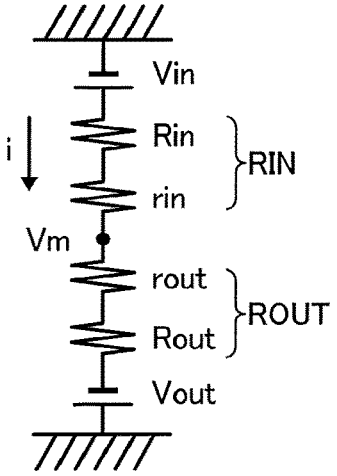
FIG. 7 is a schematic circuit diagram to illustrate a structure of the common chamber of the head according to a second embodiment.

FIG. 7 is an equivalent circuit from the supply ports 41*a* and 41*b* to the discharge ports 42*a* and 42*b*.

When a positive pressure is applied to the supply-side common chamber 10 of the head 404 and a negative pressure is applied to the discharge-side common chamber 50, a liquid flow that flows from the supply-side common chamber 10A toward the discharge-side common chamber 50 via the individual chamber 6, the nozzles 4, and the discharge channel 56, etc.

The liquid is again supplied to the supply-side common chamber 10 via an external circulation path.

Here, as also illustrated in FIG. 6,

A pressure of the liquid to be supplied to the supply-side common chamber 10: Vin [Pa], A pressure of the liquid to be supplied to the discharge-side common chamber 50: Vout [Pa], A fluid resistance at a supply side of a supply system: RIN [Pa·sec/$m^3$]

A meniscus pressure Vm [Pa] in the nozzles 4 and a flow rate of a circulated flow rate i [$m^3$/sec] are obtained by the following Equations 2 and 3, respectively, where the fluid resistance on the discharge side is ROUT [Pa·sec/$m^3$].

$$Vm=[(Vout+Vin\times(RIN/ROUT)]/(1+RIN/ROUT) \quad \text{[Equation 2]}$$

$$Vm=(Vin-Vout)/(RIN+ROUT) \quad \text{[Equation 3]}$$

The fluid resistance RIN on the supply side is a combined resistance of the fluid resistance Rin of the supply-side common chamber 10 and the fluid resistance rin from the supply-side liquid introduction portions 8 to the nozzle communication channel 5 via the supply-side fluid restrictors 7 and the individual chambers 6.

The fluid resistance ROUT on the discharge side is a combined resistance of the fluid resistance rout from the discharge channel 56 to the discharge-side liquid discharge portions 58 and the fluid resistance Rout of the discharge-side common chamber 50.

As described above, the lengths of the supply-side common chamber 10 and the discharge-side common chamber 50 are different between the nozzle arrays 4A and 4B. Thus, the fluid resistance Rin and Rout are different. A difference between the fluid resistance Rin and Rout changes a flow rate in the circulated liquid and causes a variation in the discharge characteristics.

Therefore, the present embodiment sets the fluid resistance to "Rin1+Rout1=Rin2+Rout2" to enable to reduce variations in the fluid resistance in the common chambers and to reduce variations in discharge characteristics.

Here, the fluid resistance is obtained by the Equation 1 as described above. Thus, the fluid resistance can be changed by changing the height and the width of the flow path of the supply-side common chamber 10A and 10B and the discharge-side common chamber 50A and 50B.

A third embodiment according to the present disclosure is described with reference to FIG. 8.

Figure 8:
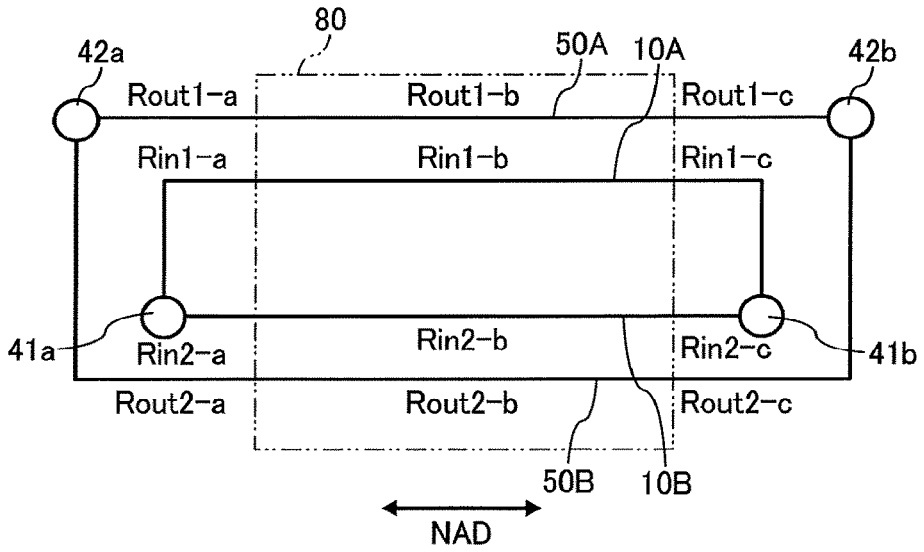
FIG. 8 is a schematic circuit diagram to illustrate a structure of the common chambers of the head according to a third embodiment.

FIG. 8 is a schematic circuit diagram to illustrate a structure of the common chamber according to the third embodiment.

In the present embodiment, the shape of the flow path of the supply-side common chambers 10A and 10B is the same in a region 80 where the individual chambers 6 are arranged in the nozzle array direction (NAD).

Similarly, the shape of the flow path of the discharge-side common chambers 50A and 50B is the same in the region 80 where the individual chambers 6 are arranged in the nozzle array direction (NAD).

Thus, the plurality of supply-side common chambers 10A and 10B has a same shape in a region 80 where the individual chambers 6 are arranged in the nozzle array direction (NAD).

As a result, fluid resistances Rin1-*b* and Rin2-*b* of a part corresponding to the region 80 in the supply-side common chambers 10A and 10B becomes the same. The individual chambers 6 are arranged in the nozzle array direction (NAD) in the region 80.

Similarly, fluid resistances Rout1-*b* and Rout2-*b* of a part corresponding to the region 80 in the discharge-side common chambers 50A and 50B becomes the same.

The individual chambers 6 are arranged in the nozzle array direction (NAD) in the region 80.

The shapes of the flow path of a part other than the part corresponding to the region 80 in the supply-side common chambers 10A and 10B or the discharge-side common chambers 50A and 50B are made different. The individual chambers 6 are arranged in the nozzle array direction (NAD) in the region 80.

As a result, the present embodiment is configured to satisfy the relation of "Rin1+Rout1=Rin2+Rout2", "Rout1=Rout2", or "Rin1=Rin2" in the fluid resistances of Rin1-*a*, Rin1-*c*, Rin2-*a*, Rin2-*c*, Rout 1-*a*, Rout1-*c*, Rout2-*a*, and Rout2*c* on both sides (outside) of the part corresponding to the region 80 where the individual chambers 6 are arranged.

For example, the present embodiment can satisfy a relation of "Rin1+Rout1=Rin2+Rout2" by satisfying a relation of a following equation. Rin1-*a*×Rin1-*c*/(Rin1-*a*+Rin1-*c*)+Rout1-*a*×Rout1-*c*/(Rout1-*a*+Rout1-*c*)=Rin2-*a*×Rin2-*c*/(Rin2-*a*+Rin2-*c*)+Rout2-*a*×Rout2-*c*/(Rout2-*a*+Rout2-*c*)

Thus, the present embodiment can equalize the flow rate of the liquid circulated in each of nozzle arrays 4A and 4B without changing the discharge characteristics between the nozzle arrays 4A and 4B.

A fourth embodiment according to the present disclosure is described with reference to FIG. 9.

FIG. 9 is a schematic circuit diagram to illustrate a structure of the common chambers 10 and 50 of the head 404 according to the fourth embodiment.

The above-described embodiments have a two-side supply and two-side discharge system including two supply ports 41 and two discharge ports 42.

In contrast, the present embodiment has a configuration of an one-side supply and one-side discharge system in which one supply port 41 is arranged for the supply-side common chambers 10A and 10B, and one discharge port 42 is arranged for the discharge-side common chambers 50A and 50B.

Figure 9A:
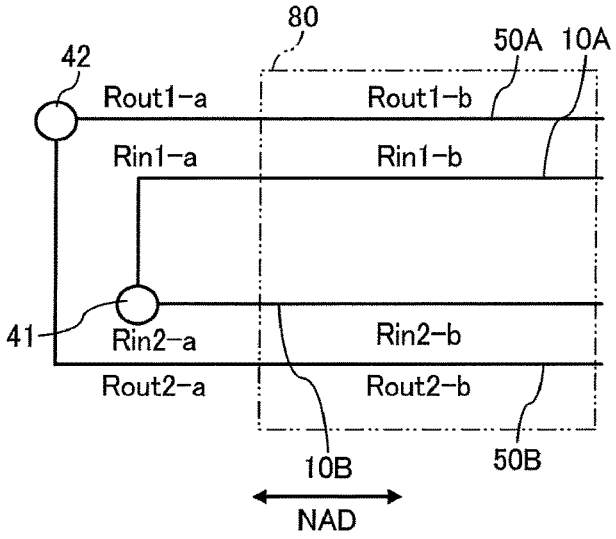
FIGS. 9A and 9B are schematic circuit diagrams illustrating a structure of the common chambers of the head according to a fourth embodiment.

In an example illustrated in FIG. 9A, the supply port 41 and the discharge port 42 are arranged on the same side in the nozzle array direction (NAD).

Figure 9B:
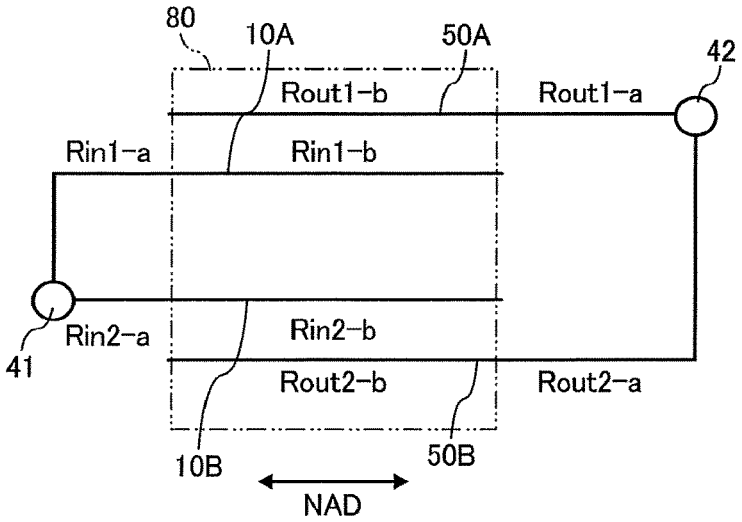

In an example illustrated in FIG. 9B, the supply port 41 and the discharge port 42 are arranged on the opposite side in the nozzle array direction (NAD).

Even in this configuration of the one-side supply and one-side discharge system, a flow rate of the liquid circulated in each of the nozzle arrays 4A and 4B can be equalized without changing the discharge characteristics between the nozzle arrays 4A and 4B by setting the fluid resistance "Rin1-*a*+Rout1-*a*=Rin2-*a*+Rout2-*a*" as in the third embodiment, for example.

Although the relation of the fluid resistance in the fourth embodiment is the same as the relation of the fluid resistance of the third embodiment, the relation of the fluid resistance of the fourth embodiment may be the same as the relation of the fluid resistance in the first embodiment or the second embodiment.

A fifth embodiment according to the present disclosure is described with reference to FIGS. 10 and 11.

Figure 10:
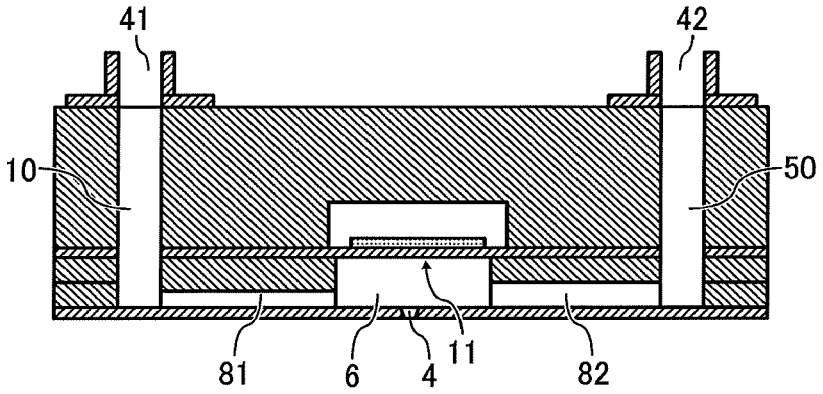
FIG. 10 is a cross-sectional view of the head along the direction perpendicular to the nozzle array direction according to a fifth embodiment.

FIG. 10 is a cross-sectional view of the head 404 along the direction perpendicular to the nozzle array direction (NAD) in the fifth embodiment.

Figure 11:
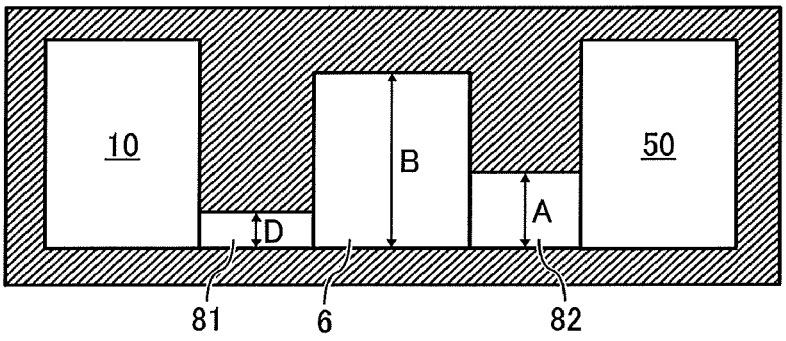
FIG. 11 is a schematic cross-sectional view of a structure of channels in the head along the direction perpendicular to the nozzle array direction in the fifth embodiment.

FIG. 11 is a schematic cross-sectional view of a structure of channels in the head 404 along the direction perpendicular to the nozzle array direction (NAD) in the fifth embodiment.

In the present embodiment, the supply-side common chamber 10 and the discharge-side common chamber 50 are arranged on the opposite side across the nozzles 4 in the direction perpendicular to the nozzle array direction (NAD).

Further, the present embodiment includes supply-side channels 81 communicating between the supply-side common chamber 10 and the individual chambers 6. The supply-side channels 81 in FIGS. 10 and 11 correspond to the individual chambers 6, the supply-side fluid restrictors 7, and the supply-side liquid introduction portions 8 as illustrated in FIGS. 3 and 4.

The present embodiment includes discharge channels 82 communicating between the individual chamber 6 and the discharge-side common chamber 50. The discharge channels 82 in FIGS. 10 and 11 correspond to the discharge channels 56 as illustrated in FIGS. 3 and 4.

A cross-sectional area perpendicular to a flow direction of the liquid is referred to as "opening cross-sectional area".

The opening cross-sectional area A of the discharge channel 82 is larger than the opening cross-sectional area B of the individual chamber 6 (B>A).

Thus, opening cross-sectional areas of channels (the discharge channels 82) provided between the plurality of supply-side common chambers 10 and the plurality of individual chambers 6 are smaller than opening cross-sectional areas of the plurality of discharge channels 56 in a direction perpendicular to a direction of flow of the liquid in the channels (the discharge channels 82), respectively.

As a result, a flow rate of the liquid in the discharge channel 82 increases. Thus, the liquid can be discharged smoothly to the discharge channel 82.

Further, the opening cross-sectional area D of the supply-side channel 81 is smaller than the opening cross-sectional area A of the discharge channel 82 (A>D).

Thus, the present embodiment can prevent backflow of the liquid from the individual chamber 6 to the supply-side channel 81 when the individual chamber 6 is pressurized.

A sixth embodiment according to the present disclosure is described with reference to FIG. 12.

Figure 12:
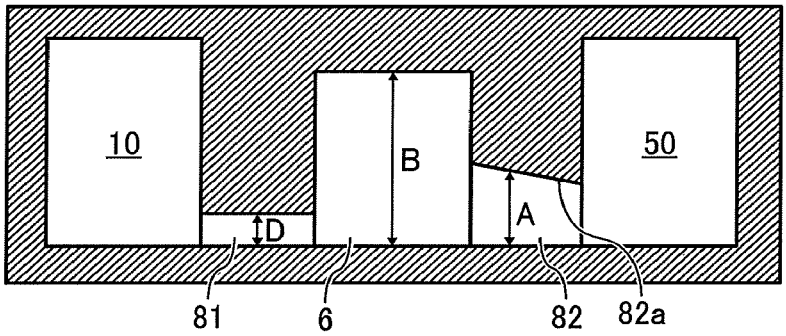
FIG. 12 is a schematic cross-sectional view of a structure of channels of the head along the direction perpendicular to the nozzle array direction (NAD) according to a sixth embodiment.

FIG. 12 is a schematic cross-sectional view of a structure of channels in the head 404 along the direction perpendicular to the nozzle array direction (NAD) in the sixth embodiment.

In the present embodiment, the opening cross-sectional area A gradually decreases from the individual chamber 6 toward the discharge-side common chamber 50 in the configuration of the head 404 according to the above-described fifth embodiment as illustrated in FIG. 11. A wall surface 82*a* of the discharge channel 82 is inclined such that a height of the discharge channel 82 decreases from the individual chamber 6 toward the discharge-side common chamber 50 as illustrated in FIG. 12.

Accordingly, the sixth embodiment can increase the flow rate of the liquid flowing through the discharge channel 82 from the individual chamber 6 toward the discharge-side common chamber 50.

A seventh embodiment according to the present disclosure is described with reference to FIG. 13.

Figure 13:
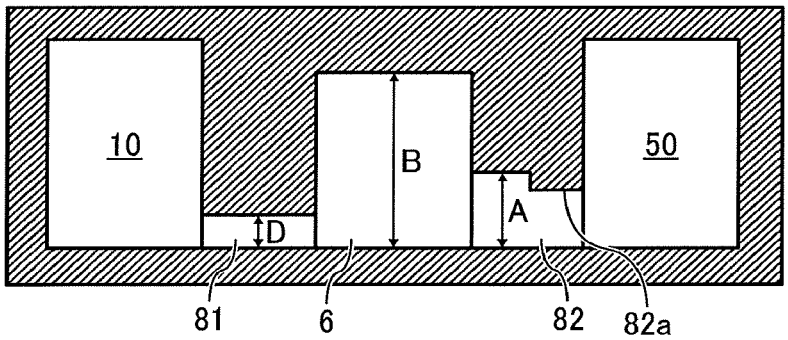
FIG. 13 is a schematic cross-sectional view of a structure of channels in the head along the direction perpendicular to the nozzle array direction (NAD) according to a seventh embodiment.

FIG. 13 is a schematic cross-sectional view of a structure of channels in the head 404 along the direction perpendicular to the nozzle array direction (NAD) in the seventh embodiment.

In the present embodiment, the opening cross-sectional area A decreases stepwise from the individual chamber 6 toward the discharge-side common chamber 50 in the configuration of the head 404 according to the above-described fifth embodiment as illustrated in FIG. 11. A wall surface 82*a* of the discharge channel 82 has a step in which a height of the discharge channel 82 decreases stepwise from the individual chamber 6 toward the discharge-side common chamber 50 as illustrated in FIG. 13.

Accordingly, the seventh embodiment can significantly increase the flow rate of the liquid flowing through the discharge channel 82 from the individual chamber 6 toward the discharge-side common chamber 50.

Figure 14:
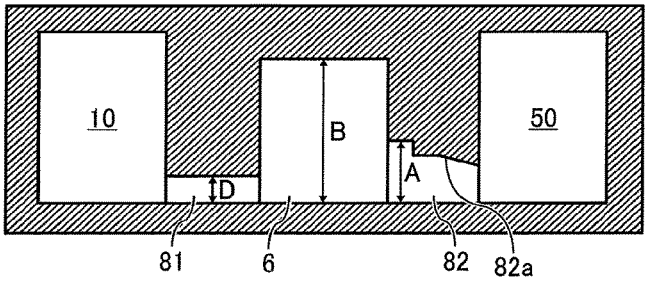
FIG. 14 is a schematic cross-sectional view of a structure of channels in the head along the direction perpendicular to the nozzle array direction (NAD) according to an eighth embodiment.

FIG. 14 illustrates an eighth embodiment according to the present disclosure.

FIG. 14 is a schematic cross-sectional view of a structure of channels in the head 404 along the direction perpendicular to the nozzle array direction (NAD) in the eighth embodiment.

In the present embodiment, the opening cross-sectional area A decreases stepwise and then gradually (continuously) decreases from the individual chamber 6 toward the discharge-side common chamber 50 in the configuration of the head 404 according to the above-described fifth embodiment as illustrated in FIG. 11. A wall surface 82*a* of the discharge channel 82 has a step in an upstream side and a slope in a downstream side of the discharge channel 82 so that a height of the discharge channel 82 decreases stepwise and then decreases continuously from the individual chamber 6 toward the discharge-side common chamber 50 as illustrated in FIG. 14.

Accordingly, the sixth embodiment can increase the flow rate of the liquid flowing through the discharge channel 82 from the individual chamber 6 toward the discharge-side common chamber 50.

A ninth embodiment according to the present disclosure is described with reference to FIG. 15.

Figure 15:
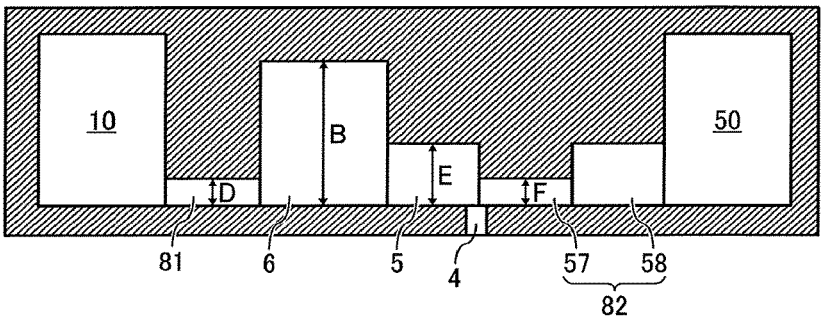
FIG. 15 is a schematic cross-sectional view of a structure of channels in the head along the direction perpendicular to the nozzle array direction (NAD) according to a ninth embodiment.

FIG. 15 is a schematic cross-sectional view of a structure of channels in the head 404 along the direction perpendicular to the nozzle array direction (NAD) in the ninth embodiment.

In the present embodiment, the nozzle 4 communicates with the individual chamber 6 via the nozzle communication channel 5.

The discharge channel 82 includes a discharge-side fluid restrictor 57 and the discharge-side liquid discharge portions 58. The discharge-side fluid restrictor 57 communicates with the individual chamber 6 via the nozzle communication channel 5.

The present embodiment set a relation between the opening cross-sectional area B of the individual chamber 6, the opening cross-sectional area E of the nozzle communication channel 5, and the opening cross-sectional area F of the discharge-side fluid restrictor 57 to be B>E>F.

As a result, the flow rate increases from the individual chamber 6 toward the discharge-side fluid restrictor 57 via the nozzle communication channel 5. Thus, the liquid can be discharged smoothly to the discharge side from the individual chamber 6 toward the discharge-side fluid restrictor 57.

A tenth embodiment according to the present disclosure is described with reference to FIG. 16.

Figure 16:
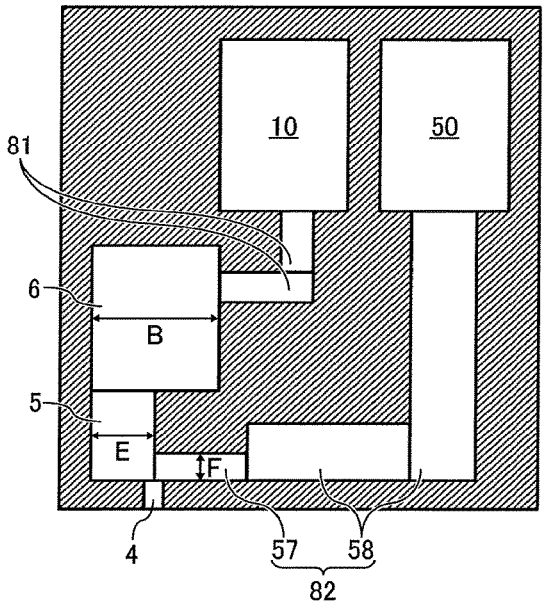
FIG. 16 is a schematic cross-sectional view of a structure of channels in the head along the direction perpendicular to the nozzle array direction (NAD) according to a tenth embodiment.

FIG. 16 is a schematic cross-sectional view of a structure of channels in the head 404 along the direction perpendicular to the nozzle array direction (NAD) in the tenth embodiment.

In the present embodiment, the supply-side common chamber 10 and the discharge-side common chamber 50 are arranged side by side.

Other configurations are the same as the configurations of the ninth embodiment.

The present embodiment set a relation between the opening cross-sectional area B of the individual chamber 6, the opening cross-sectional area E of the nozzle communication channel 5, and the opening cross-sectional area F of the discharge-side fluid restrictor 57 to be B>E>F.

As a result, the flow rate gradually increases from the individual chamber 6 toward the discharge-side fluid restrictor 57 via the nozzle communication channel 5. Thus, the liquid can be discharged smoothly to the discharge side from the individual chamber 6 toward the discharge-side fluid restrictor 57.

An eleventh embodiment according to the present disclosure is described with reference to FIG. 17.

Figure 17:
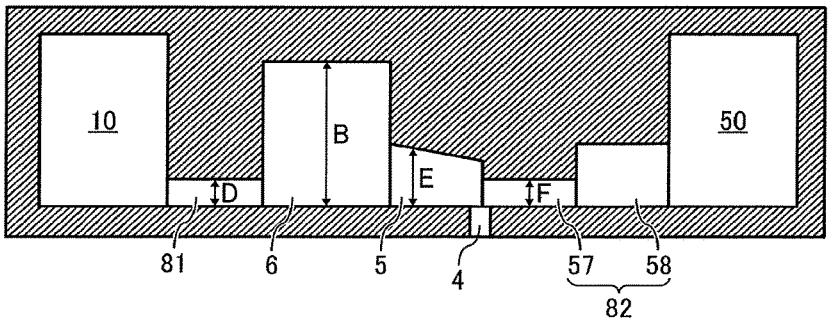
FIG. 17 is a schematic cross-sectional view of a structure of channels in the head along the direction perpendicular to the nozzle array direction (NAD) according to an eleventh embodiment.

FIG. 17 is a schematic cross-sectional view of a structure of channels in the head 404 along the direction perpendicular to the nozzle array direction (NAD) in the eleventh embodiment.

In the eleventh embodiment, the wall surface 5*a* of the nozzle communication channel 5 has a slope such that the opening cross-sectional area E gradually (continuously) decreases from the individual chamber 6 toward the discharge-side fluid restrictor 57.

Accordingly, the eleventh embodiment can increase the flow rate in the nozzle communication channel 5.

A twelfth embodiment according to the present disclosure is described with reference to FIG. 18.

Figure 18:
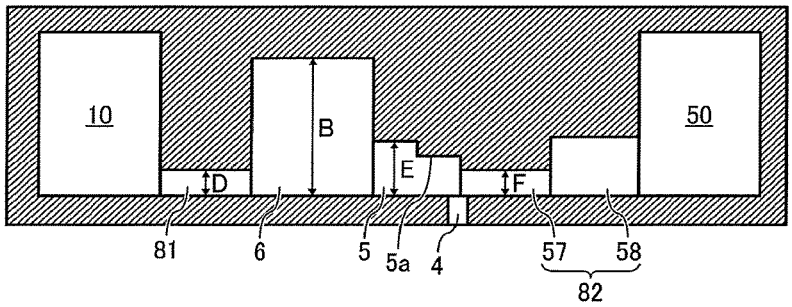
FIG. 18 is a schematic cross-sectional view of a structure of channels in the head along the direction perpendicular to the nozzle array direction (NAD) according to a twelfth embodiment.

FIG. 18 is a schematic cross-sectional view of a structure of channels in the head 404 along the direction perpendicular to the nozzle array direction (NAD) in the twelfth embodiment.

In the twelfth embodiment, the wall surface 5*a* of the nozzle communication channel 5 has a step such that the opening cross-sectional area E decreases stepwise from the individual chamber 6 toward the discharge-side fluid restrictor 57.

Accordingly, the twelfth embodiment can increase the flow rate in the nozzle communication channel 5.

A thirteenth embodiment according to the present disclosure is described with reference to FIG. 19.

Figure 19:
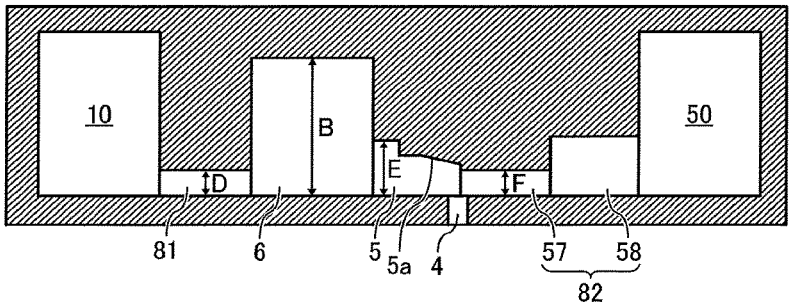
FIG. 19 is a schematic cross-sectional view of a structure of channels in the head along the direction perpendicular to the nozzle array direction (NAD) according to a thirteenth embodiment.

FIG. 19 is a schematic cross-sectional view of a structure of channels in the head 404 along the direction perpendicular to the nozzle array direction (NAD) in the thirteenth embodiment.

In the thirteenth embodiment, the wall surface 5*a* of the nozzle communication channel 5 has a step in an upstream side (close to the individual chamber 6) and a slope in a downstream side (close to the discharge-side fluid restrictor 57) of the nozzle communication channel 5.

Thus, the opening cross-sectional area E decreases stepwise and then gradually (continuously) decreases from the individual chamber 6 toward the discharge-side fluid restrictor 57.

Accordingly, the thirteenth embodiment can increase the flow rate in the nozzle communication channel 5.

A fourteenth embodiment according to the present disclosure is described with reference to FIG. 20.

Figure 20:
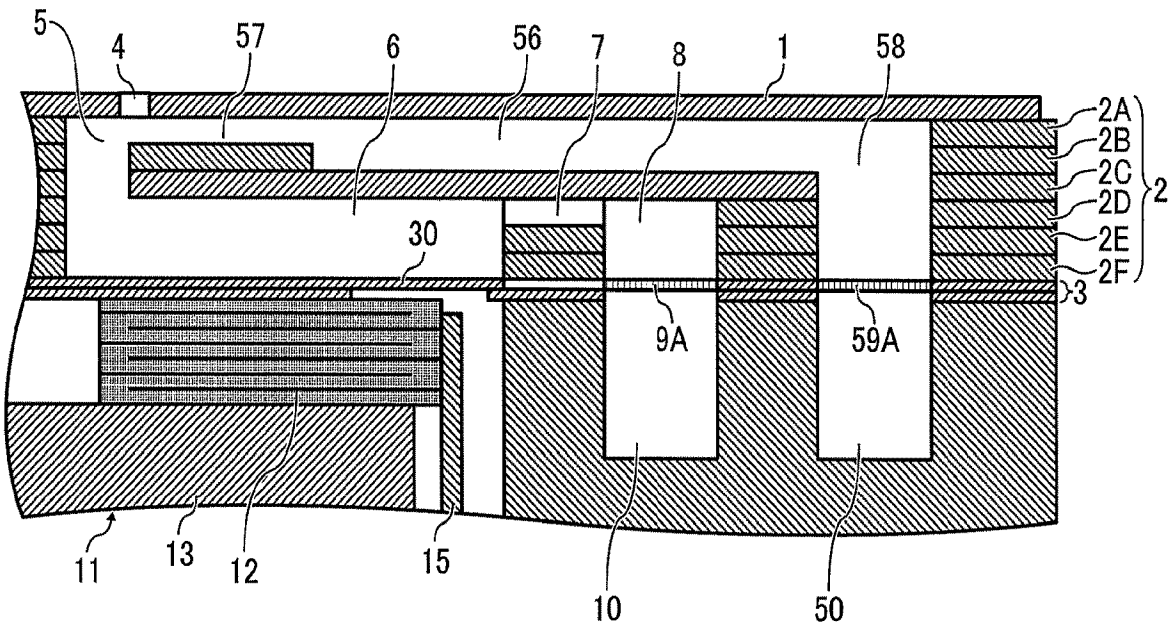
FIG. 20 is a cross-sectional view of the head along the direction perpendicular to the nozzle array direction (NAD) according to a fourteenth embodiment.

FIG. 20 is a cross-sectional view of the head 404 along the direction perpendicular to the nozzle array direction (NAD) in the fourteenth embodiment.

In the fourteenth embodiment, the discharge-side fluid restrictor 57 is provided at the nozzle communication channel 5 side of the discharge channel 56 in the configuration of the first embodiment illustrated in FIG. 4.

As in the ninth embodiment, the opening cross-sectional area B of the individual chamber 6, the opening cross-sectional area E of the nozzle communication channel 5, and the opening cross-sectional area F of the discharge-side fluid restrictor 57 satisfy the relation of B>E>F.

As a result, the flow rate gradually increases from the individual chamber 6 toward the discharge-side fluid restrictor 57 via the nozzle communication channel 5. Thus, the liquid can be discharged smoothly to the discharge side from the individual chamber 6 toward the discharge-side fluid restrictor 57.

In the present embodiment, the channel substrate 2 includes six plate members 2A through 2G laminated one on another.

Further, the piezoelectric actuator 11 holds the piezoelectric element 12 on a base 13.

A wiring member 15 is connected to the piezoelectric element 12.

Further, a supply-side filter 9A is disposed between the supply-side common chamber 10 and the supply-side liquid introduction portions 8. A discharge-side filter 59A is disposed between the discharge-side common chamber 50 and the discharge-side liquid discharge portions 58.

Figure 21:
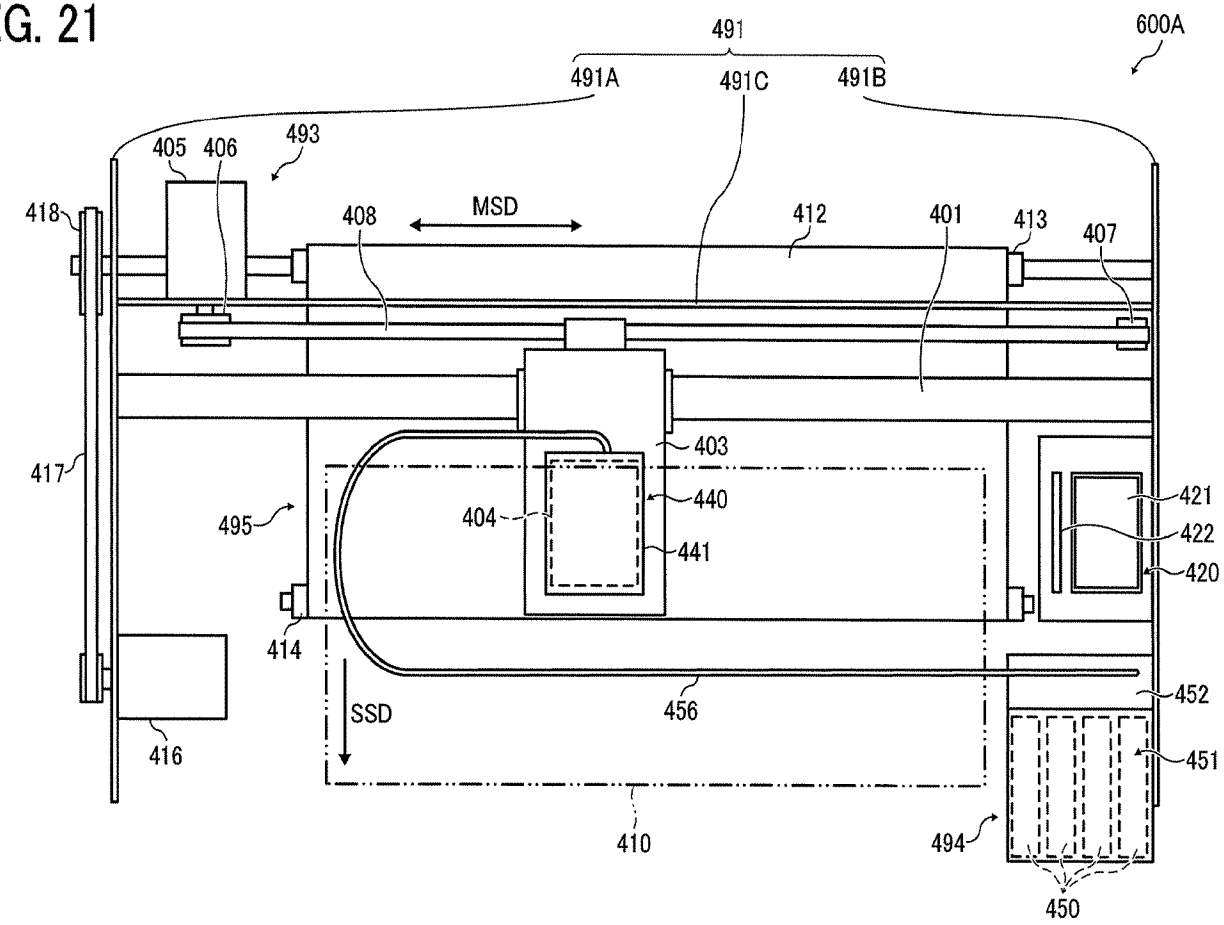
FIG. 21 is a plan view of a main part of a liquid discharge apparatus according to an embodiment of the present disclosure.
Figure 22:
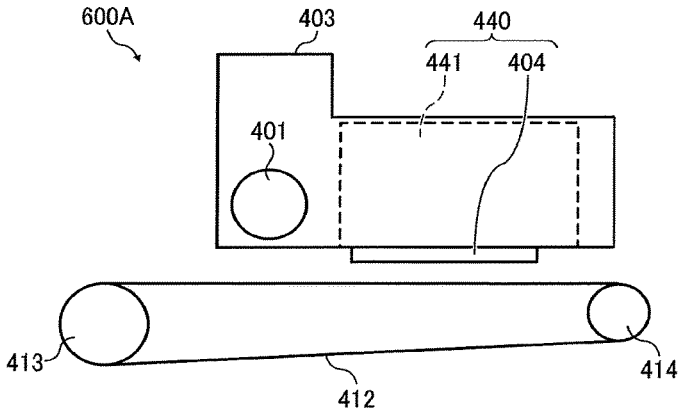
FIG. 22 is a side view of a main part of the liquid discharge apparatus.

FIGS. 21 and 22 illustrate an example of a liquid discharge apparatus 600A according to the present embodiment.

FIG. 21 is a plan view of a main part of the liquid discharge apparatus 600A.

FIG. 22 is a side view of a main part of the liquid discharge apparatus 600A.

The liquid discharge apparatus 600A is a serial-type apparatus in which a main scan drive unit 493 reciprocally moves a carriage 403 in a main scanning direction indicated by arrow MSD in FIG. 21. The main scan drive unit 493 serves as a drive unit to reciprocally move a carriage 403 in the main scanning direction MSD.

The main scan drive unit 493 includes a guide 401, a main scanning motor 405, a timing belt 408, etc.

The guide 401 is laterally bridged between a left side plate 491A and a right side plate 491B and supports the carriage 403 so that the carriage 403 is movable along the guide 401.

The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the head 404 according to the present embodiment and a head tank 441 are integrated as a single unit.

The head 404 of the liquid discharging device 440 discharges color liquids of, for example, yellow (Y), cyan (C), magenta (M), and black (K).

The head 404 includes nozzle arrays 4A and 4B (See FIG. 2), each including the plurality of nozzles 4 arrayed in row in a sub-scanning direction indicated by arrow SSD in FIG. 21. The sub-scanning direction (SSD) is perpendicular to the main scanning direction MSD. The head 404 is mounted to the carriage 403 so that ink droplets are discharged downward.

The liquid stored outside the head 404 is supplied to the head 404 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump.

The liquid cartridge 450 is detachably attached to the cartridge holder 451.

The liquid is supplied to the head tank 441 by the liquid feed unit 452 via the tube 456 from the liquid cartridge 450.

The liquid discharge apparatus 600A includes a conveyance unit 495 to convey a sheet 410.

The conveyance unit 495 includes a conveyance belt 412 as a conveyor and a sub-scanning motor 416 to drive the conveyance belt 412.

The conveyance belt 412 attracts the sheet 410 and conveys the sheet 410 at a position facing the head 404.

The conveyance belt 412 is in the form of an endless belt. The conveyance belt 412 is stretched between a conveyance roller 413 and a tension roller 414.

The sheet 410 is attracted to the conveyance belt 412 by electrostatic force or air suction.

The conveyance roller 413 is rotated by a sub-scanning motor 416 via a timing belt 417 and a timing pulley 418, so that the conveyance belt 412 circulates in a sub-scanning direction (SSD) in FIG. 21.

At one side in the main scanning direction (MSD) of the carriage 403, a maintenance unit 420 to recover the head 404 in good condition is disposed on a lateral side (right-hand side) of the conveyance belt 412 in FIG. 21.

The maintenance unit 420 includes, for example, a cap 421 to cap a nozzle face of the head 404 and a wiper 422 to wipe the nozzle face. The nozzle face is a face on which the nozzles 4 are formed.

The main scan drive unit 493, the supply unit 494, the maintenance unit 420, and the conveyance unit 495 are mounted to a housing 491 that includes the left side plate 491A, the right side plate 491B, and a rear side plate 491C.

In the liquid discharge apparatus 600A thus configured, a sheet 410 is conveyed on and attracted to the conveyance belt 412 and is conveyed in the sub-scanning direction (SSD) by the cyclic rotation of the conveyance belt 412.

The head 404 is driven in response to image signals while the carriage 403 moves in the main scanning direction (MSD), to discharge liquid to the sheet 410 stopped, thus forming an image on the sheet 410.

As described above, the liquid discharge apparatus 600A includes the head 404 according to the present embodiment, thus allowing stable formation of high quality images.

Figure 23:
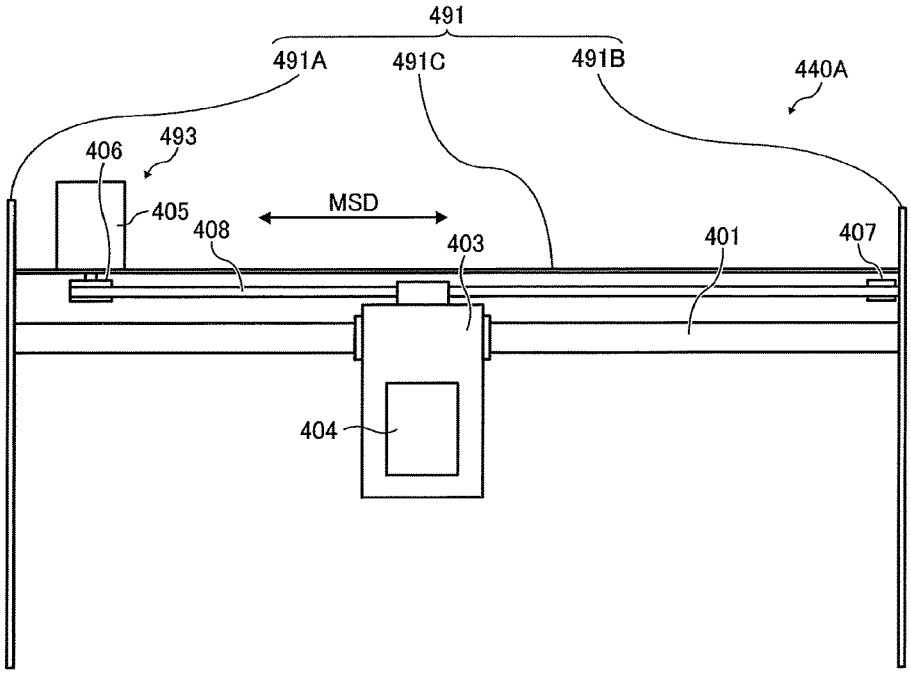
FIG. 23 is a plan view of an example of a main part of a liquid discharge device.

FIG. 23 illustrates another example of the liquid discharge device 440A according to another embodiment of the present disclosure.

FIG. 23 is a plan view of a main part of the liquid discharge device 440A.

The liquid discharge device 440A includes the housing 491, the main scan drive unit 493, the carriage 403, and the head 404 among components of the liquid discharge apparatus 600A. The left side plate 491A, the right side plate 491B, and the rear side plate 491C constitute the housing 491.

Note that, in the liquid discharge device 440A, at least one of the maintenance unit 420 and the supply unit 494 described above may be mounted on, for example, the right side plate 491B.

Figure 24:
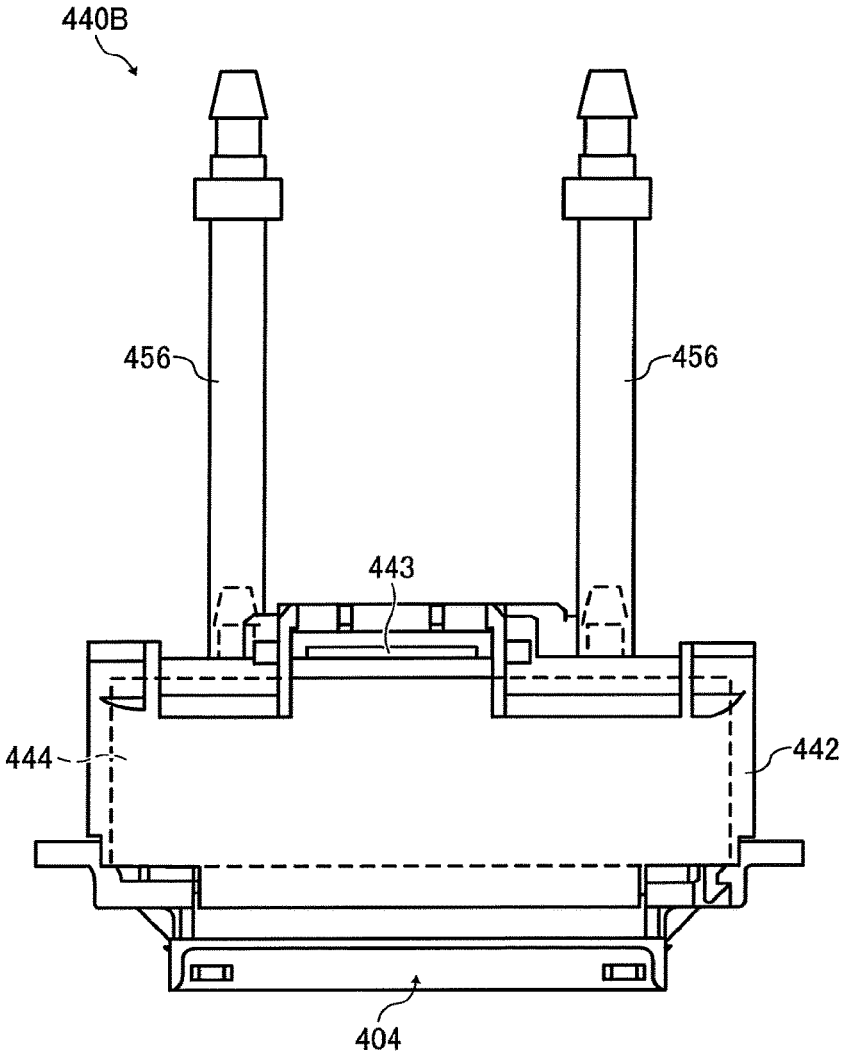
FIG. 24 is a front view of still another example of the liquid discharge device.

FIG. 24 illustrates still another example of the liquid discharge device 440B according to the present embodiment.

FIG. 24 is a front view of the liquid discharge device 440B.

The liquid discharge device 440B includes the head 404 to which a channel part 444 is mounted and a tube 456 connected to the channel part 444.

Further, the channel part 444 is disposed inside a cover 442.

Instead of the channel part 444, the liquid discharge device 440B may include the head tank 441.

A connector 443 to electrically connect the head 404 to a power source is disposed above the channel part 444.

Figure 25:
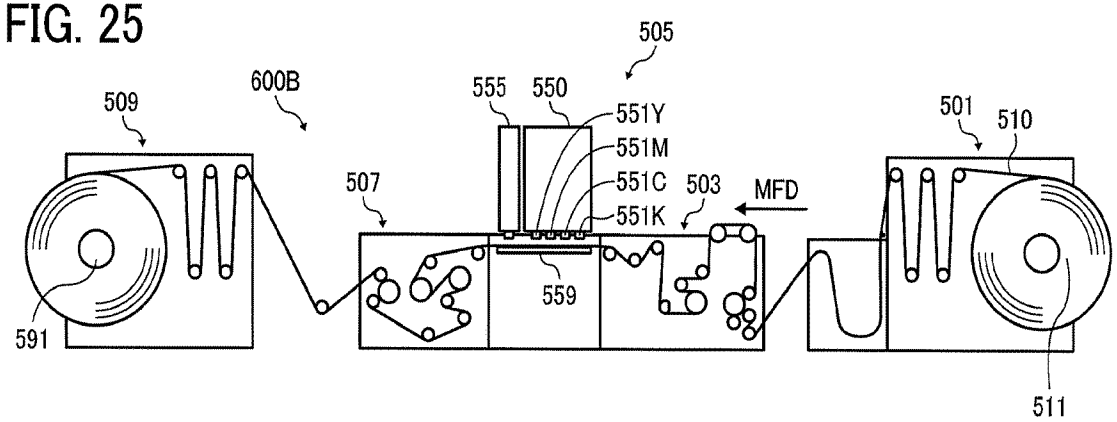
FIG. 25 is a front view a liquid discharge apparatus according to still another embodiment of the present disclosure.
Figure 26:
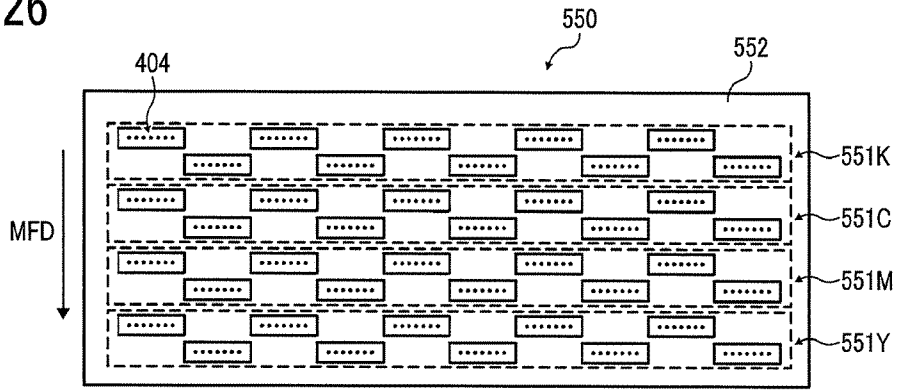
FIG. 26 is a plan view of a head unit of the liquid discharge apparatus of FIG. 25.

FIGS. 25 and 26 illustrate an example of a liquid discharge apparatus 600B according to the present embodiment.

FIG. 25 is a schematic front view of the liquid discharge apparatus 600B.

FIG. 26 is a plan view of a head unit 550 of the liquid discharge apparatus 600B of FIG. 24.

The liquid discharge apparatus 600B according to the present embodiment includes a feeder 501 to feed a medium 510, a guide conveyor 503 to guide and convey the medium 510, fed from the feeder 501, to a printing unit 505, the printing unit 505 to discharge liquid onto the medium 510 to form an image on the medium 510, a drier unit 507 to dry the medium 510, and an ejector 509 to eject the medium 510. The medium 510 is a continuous medium such as a rolled sheet.

The medium 510 is fed from a winding roller 511 of the feeder 501, guided and conveyed with rollers of the feeder 501, the guide conveyor 503, the drier unit 507, and the ejector 509, and wound around a take-up roller 591 of the ejector 509.

In the printing unit 505, the medium 510 is conveyed opposite a first head unit 550 and a second head unit 555 on a conveyance guide 559. The first head unit 550 discharges liquid to form an image on the medium 510. Post-treatment is performed on the medium 510 with treatment liquid discharged from the second head unit 555.

Here, the first head unit 550 includes, for example, four-color full-line head arrays 551K, 551C, 551M, and 551Y (hereinafter, collectively referred to as "head arrays 551" unless colors are distinguished) from an upstream side in a feed direction of the medium 510 (hereinafter, "medium feed direction") indicated by arrow MFD in FIG. 25.

The head arrays 551K, 551C, 551M, and 551Y are liquid dischargers to discharge liquid of black (K), cyan (C), magenta (M), and yellow (Y) onto the medium 510.

Note that the number and types of color are not limited to the above-described four colors of K, C, M, and Y and may be any other suitable number and types.

In each head array 551, for example, as illustrated in FIG. 26, the heads 404 are staggered on a base 552 to form the head array 551. Note that the configuration of the head array 551 is not limited to such a configuration.

Next, an example of a liquid circulation system 630 according to an embodiment of the present disclosure is described with reference to FIG. 27.

Figure 27:
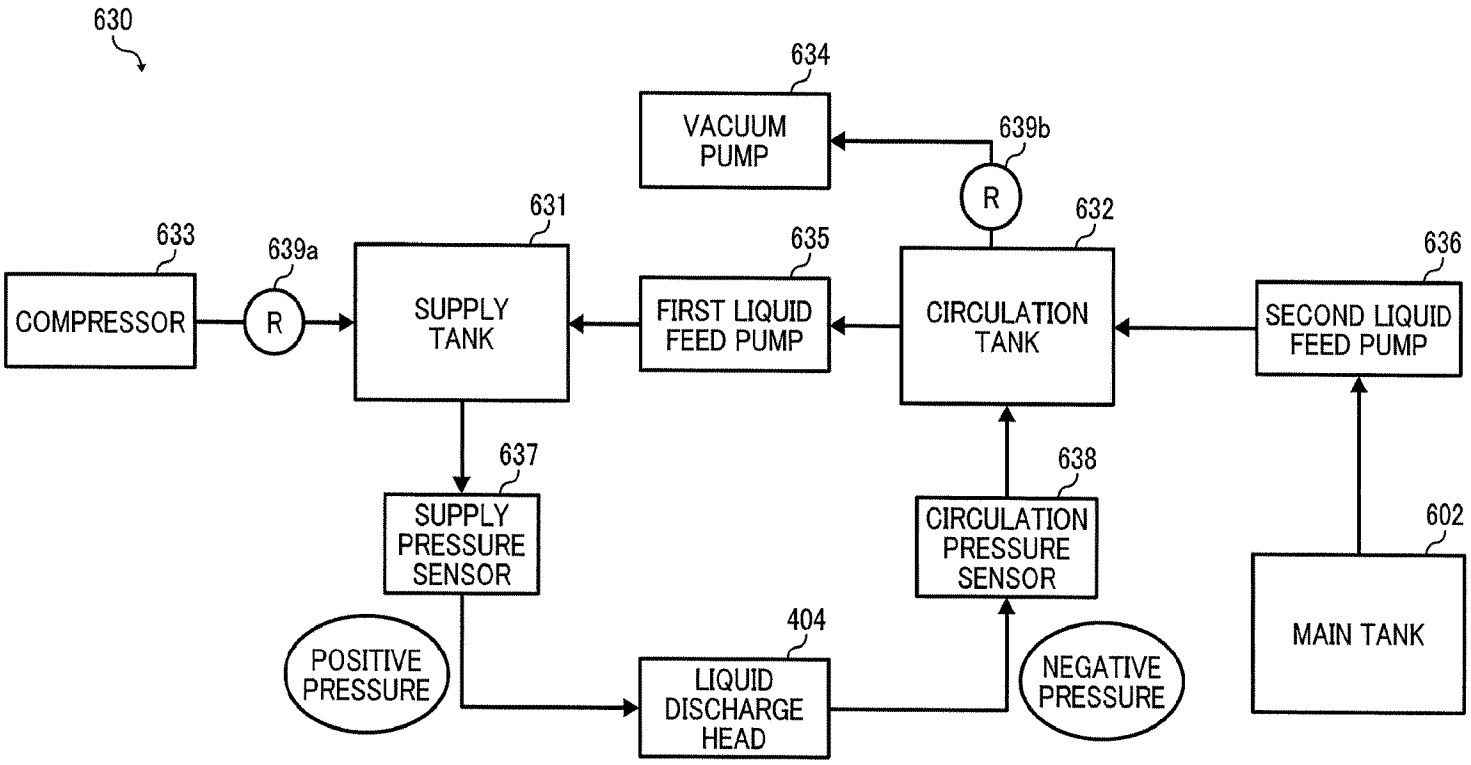
FIG. 27 is a block diagram of a liquid circulation system of the liquid discharge apparatus of FIG. 25.

FIG. 27 is a block diagram of the liquid circulation system 630 according to an embodiment of the present disclosure.

As illustrated in FIG. 27, the liquid circulation system 630 includes a main tank 602, the heads 404, a supply tank 631, a circulation tank 632, a compressor 633, a vacuum pump 634, a first liquid feed pump 635, a second liquid feed pump 636, a supply pressure sensor 637, a circulation pressure sensor 638, and a regulator (R) 639*a* and 639*b*.

The supply pressure sensor 637 is disposed between the supply tank 631 and the heads 404 and connected to a supply channel connected to the supply ports 41*a* and 41*b* (see FIG. 3) of the heads 404.

The circulation pressure sensor 638 is disposed between the circulation tank 632 and the heads 404 and connected to a discharge channel connected to the discharge ports 42*a* and 42*b* (see FIG. 3) of the heads 404.

One end of the circulation tank 632 is connected with the supply tank 631 via the first liquid feed pump 635 and the other end of the circulation tank 632 is connected with the main tank 602 via the second liquid feed pump 636.

Thus, liquid is sent from the supply tank 631 into the heads 404 through the supply ports 41*a* and 41*b* and discharged from the discharge ports 42*a* and 42*b* to the circulation tank 632.

Further, the first liquid feed pump 635 feeds liquid from the circulation tank 632 to the supply tank 631, thus circulating liquid.

The supply tank 631 is connected to the compressor 633 and controlled so that a predetermined positive pressure is detected with the supply pressure sensor 637.

The circulation tank 632 is connected to the vacuum pump 634 and controlled so that a predetermined negative pressure is detected with the circulation pressure sensor 638.

Such a configuration allows the menisci of ink to be maintained at a constant negative pressure while circulating ink through the inside of the heads 404.

When the liquid is discharged from the nozzles 4 of the heads 404, the amount of liquid in each of the supply tank 631 and the circulation tank 632 decreases.

Hence, the second liquid feed pump 636 properly replenishes liquid from the main tank 602 to the circulation tank 632.

Replenishment of the liquid from the main tank 602 to the circulation tank 632 is controlled in accordance with a result of detection with, e.g., a liquid level sensor in the circulation tank 632, for example, in a manner in which liquid is replenished when the liquid level of liquid in the circulation tank 632 is lower than a predetermined height.

In the present disclosure, the discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

The "liquid discharge device" is an integrated unit including the head and a functional part(s) or unit(s), and is an assembly of parts relating to liquid discharge.

For example, "the liquid discharge device" may be a combination of the head with at least one of a head tank, a carriage, a supply unit, a maintenance unit, and a main scan drive unit.

Herein, the terms "integrated" or "united" mean fixing the head and the functional parts (or mechanism) to each other by fastening, screwing, binding, or engaging and holding one of the head and the functional parts movably relative to the other.

The head may be detachably attached to the functional part(s) or unit(s). For example, the head and a head tank maybe integrated into a single unit as the liquid discharge device.

The head and the head tank may be connected to each other via, e.g., a tube, to form the integrated liquid discharge device.

Here, a unit including a filter may further be added to a portion between the head tank and the head of the liquid discharge device.

The liquid discharge device may be an integrated unit in which a head is integrated with a carriage.

The liquid discharge device may be the head movably held by a guide that forms part of a main scan drive unit, so that the head and the main scan drive unit are integrated as a single unit.

The liquid discharge device may include the head, the carriage, and the main scan drive unit that are integrated as a single unit.

In another example, the cap that forms part of the maintenance unit is secured to the carriage mounting the head so that the head, the carriage, and the maintenance unit are integrated as a single unit to form the liquid discharge device.

Further, the liquid discharge device may include tubes connected to the head mounted on the head tank or the channel member so that the head and the supply unit are integrated as a single unit.

Liquid is supplied from a liquid reservoir source such as liquid cartridge to the head through the tube.

The main scan drive unit may be a guide only.

The supply unit may be a tube(s) only or a mount part (loading unit) only.

The term "liquid discharge apparatus" used herein also represents an apparatus including the head or the liquid discharge device to discharge liquid by driving the head.

The liquid discharge apparatus may be, for example, an apparatus capable of discharging liquid onto a material to which liquid can adhere or an apparatus to discharge liquid into gas or another liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid.

For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell. The "medium on which liquid can be adhered" includes any medium on which liquid is adhered, unless particularly limited.

Examples of "the material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a head and a medium on which liquid can be adhered. However, the liquid discharge apparatus is not limited to such an apparatus.

For example, the liquid discharge apparatus may be a serial head apparatus that moves the head or a line head apparatus that does not move the head.

Examples of "the liquid discharge apparatus" further include a treatment liquid coating apparatus to discharge a treatment liquid to a sheet surface to coat the sheet surface with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

In the present disclosure, discharged "liquid" is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant.

Such a solution, a suspension, or an emulsion can be, e.g., inkjet ink, surface treatment solution, a liquid for forming components of electronic element or light-emitting element or a resist pattern of electronic circuit, or a material solution for three-dimensional fabrication.

The "liquid discharge head" includes an energy source for generating energy to discharge liquid. Examples of the energy source include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

In the present disclosure, "liquid discharge apparatus" refers to an apparatus including a liquid discharge head or a liquid discharge unit, configured to discharge a liquid by driving the liquid discharge head.

The liquid discharge apparatus may be, for example, an apparatus capable of discharging liquid onto a material to which liquid can adhere or an apparatus to discharge liquid into a gas or another liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid.

For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell. The "medium on which liquid can be adhered" includes any medium on which liquid is adhered, unless particularly limited.

Examples of "the material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a head and a medium on which liquid can be adhered. However, the liquid discharge apparatus is not limited to such an apparatus.

For example, the liquid discharge apparatus may be a serial head apparatus that moves the head or a line head apparatus that does not move the head.

Examples of "the liquid discharge apparatus" further include a treatment liquid coating apparatus to discharge a treatment liquid to a sheet surface to coat the sheet surface with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a plurality of nozzles to discharge a liquid:

a plurality of individual chambers communicating with the plurality of nozzles;

a plurality of discharge channels communicating with the plurality of individual chambers;

a plurality of supply-side common chambers connected to the plurality of individual chambers; and a plurality of discharge-side common chambers connected to the plurality of discharge channels, the plurality of discharge-side common chambers having a same fluid resistance, and the plurality of discharge-side common chambers being nonoverlapping in a flow of the liquid through at least one of the plurality of discharge-side common chambers.

2. The liquid discharge head according to claim 1, wherein the plurality of supply-side common chambers has a same fluid resistance.

3. The liquid discharge head according to claim 1, wherein:

the plurality of supply-side common chambers includes a first supply-side common chamber and a second supply-side common chamber connected with each other, and the plurality of discharge-side common chambers includes a first discharge-side common chamber and a second discharge-side common chamber connected with each other, ends of the first supply-side common chambers are connected to ends of the second supply-side common chambers, respectively, ends of the first discharge-side common chamber are connected to ends of the second discharge-side common chamber, respectively, and a sum of a fluid resistance of the first supply-side common chamber and a fluid resistance of the first discharge-side common chamber is equal to a sum of a fluid resistance of the second supply-side common chamber and a fluid resistance of the second discharge-side common chamber.

4. The liquid discharge head according to claim 3, wherein a length of the first discharge-side common chamber is shorter than a length of the second discharge-side common chamber.

5. The liquid discharge head according to claim 4, wherein:

a length of the first supply-side common chamber is longer than a length of the second supply-side common chamber, the length of the first supply-side common chamber is longer than the length of the first discharge-side common chamber, and the length of the second supply-side common chamber is shorter than the length of the second discharge-side common chamber.

6. The liquid discharge head according to claim 3, wherein:

the first supply-side common chamber is connected to the first discharge-side common chamber via a first group of the plurality of individual chambers and the plurality of discharge channels, and the second supply-side common chamber is connected to the second discharge-side common chamber via a second group of the plurality of individual chambers and the plurality of discharge channels.

7. The liquid discharge head according to claim 1, wherein the plurality of supply-side common chambers has a same shape in a region where the plurality of individual chambers are arranged in a nozzle array direction.

8. The liquid discharge head according to claim 1, wherein opening cross-sectional areas of channels provided between the plurality of supply-side common chambers and the plurality of individual chambers are smaller than opening cross-sectional areas of the plurality of discharge channels in a direction perpendicular to a direction of flow of the liquid in the channels, respectively.

9. A liquid discharge device comprising the liquid discharge head according to claim 1.

10. The liquid discharge device according to claim 9, further comprising at least one of:

a head tank to store the liquid to be supplied to the liquid discharge head;

a carriage to mount the liquid discharge head;

a supply unit to supply the liquid to the liquid discharge head;

a maintenance unit to maintain the liquid discharge head; and a drive unit to move the carriage in a main scanning direction, to be integrated with the liquid discharge head as a single unit.

11. A liquid discharge apparatus comprising the liquid discharge device according to claim 9.

12. The liquid discharge head according to claim 1, wherein the plurality of discharge-side common chambers have the same fluid resistance without having a same length.

13. A liquid discharge head comprising:

a plurality of nozzles to discharge a liquid;

a plurality of individual chambers communicating with the plurality of nozzles;

a plurality of discharge channels communicating with the plurality of individual chambers;

a plurality of supply-side common chambers connected to the plurality of individual chambers; and a plurality of discharge-side common chambers connected to the plurality of discharge channels, the plurality of discharge-side common chambers having a same fluid resistance, the plurality of discharge-side common chambers includes a first discharge-side common chamber and a second discharge-side common chamber connected with each other, and a length of the first discharge-side common chamber is shorter than a length of the second discharge-side common chamber.

14. A liquid discharge device comprising:

a liquid discharge head including:

a plurality of nozzles to discharge a liquid, a plurality of individual chambers communicating with the plurality of nozzles, a plurality of discharge channels communicating with the plurality of individual chambers, a plurality of supply-side common chambers connected to the plurality of individual chambers, and a plurality of discharge-side common chambers connected to the plurality of discharge channels, the plurality of discharge-side common chambers having a same fluid resistance; and the liquid discharge device further comprising at least one of:

a head tank to store the liquid to be supplied to the liquid discharge head, a carriage to mount the liquid discharge head, a supply unit to supply the liquid to the liquid discharge head, a maintenance unit to maintain the liquid discharge head, and a drive unit to move the carriage in a main scanning direction, to be integrated with the liquid discharge head as a single unit.

* * * * *